US008672416B2

(12) United States Patent
Wachsmann

(10) Patent No.: US 8,672,416 B2
(45) Date of Patent: Mar. 18, 2014

(54) MILLING DRUM FOR A GROUND MILLING MACHINE AND A GROUND MILLING MACHINE

(75) Inventor: Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 181 days.

(21) Appl. No.: 13/079,407

(22) Filed: Apr. 4, 2011

(65) Prior Publication Data

US 2011/0241408 A1 Oct. 6, 2011

(30) Foreign Application Priority Data

Apr. 6, 2010 (DE) ..... 10 2010 013 983

(51) Int. Cl.
*E01C 23/12* (2006.01)
*E01C 23/088* (2006.01)

(52) U.S. Cl.
CPC ..... *E01C 23/088* (2013.01)
USPC ..... 299/39.8; 299/39.4

(58) Field of Classification Search
USPC ..... 299/39.1, 39.4, 39.8, 39.9, 40.1
See application file for complete search history.

(56) References Cited

U.S. PATENT DOCUMENTS

| | | | | |
|---|---|---|---|---|
| 6,193,444 | B1 * | 2/2001 | Jonninen | 405/258.1 |
| 6,626,500 | B1 * | 9/2003 | Cribb et al. | 299/78 |
| 7,475,949 | B2 * | 1/2009 | Helsel et al. | 299/108 |
| 7,604,301 | B1 * | 10/2009 | Lang | 299/75 |
| 7,976,239 | B2 * | 7/2011 | Hall et al. | 404/94 |
| 2005/0156459 | A1 * | 7/2005 | Roozeboom et al. | 299/39.8 |
| 2011/0089745 | A1 * | 4/2011 | Reinhardt | 299/39.4 |

FOREIGN PATENT DOCUMENTS

| | | | | |
|---|---|---|---|---|
| DE | 698 24 340 T2 | | 6/2005 | |
| DE | 102008016673 | * | 10/2009 | |
| EP | 1273411 | * | 1/2003 | B28D 1/18 |
| WO | WO03033826 | * | 4/2003 | E02F 3/20 |

* cited by examiner

*Primary Examiner* — David Bagnell
*Assistant Examiner* — Michael Goodwin
(74) *Attorney, Agent, or Firm* — Wood, Herron & Evans, LLP

(57) ABSTRACT

A ground milling machine for grinding and/or removing a ground material comprises a hollow-cylindrical drum which extends in an axially longitudinal manner and on the outside circumferential area in which several milling tools are arranged for grinding and/or removing the ground material. In order to reduce abrasion it is provided that at least one face-side milling tool is arranged on the hollow-cylindrical drum in the region of at least one face side, which milling tool protrudes beyond said face side and is provided during milling to at least partly cut free the collision region (T) between said face side and the ground material to be processed. The present invention further relates to a ground milling machine with at least one such milling drum.

15 Claims, 5 Drawing Sheets

MILLING DRUM FOR A GROUND MILLING MACHINE AND A GROUND MILLING MACHINE

The present application claims priority under 35 U.S.C. §119 of German Patent Application No. 10 2010 013 983.1, filed Apr. 6, 2010, the disclosure of which is hereby incorporated herein by reference in its entirety.

FIELD OF THE INVENTION

The invention relates to a milling drum for grinding and/or removing a ground material and also to a ground milling machine with at least one such milling drum.

BACKGROUND OF THE INVENTION

Milling drums of this kind are used for grinding and/or removing ground material, especially a compacted or solid ground material such as concrete or tar surface. Such milling drums are frequently used for removing or partly removing a road surface or the like. Such milling drums are known, for example, from DE 698 24 340 T2 and DE 296 13 658 U.

It is disadvantageous in the milling drums known from the state of the art that they are subject to strong wear and tear especially on the face side of the drum base body (also simply known as the drum) during milling. There is strong abrasion on the face side of the drum on the inside of the curves from the formed milling edge in the ground material, especially during curved milling with a relatively small curve radius (e.g. cutting free a manhole cover). The abrasion is amplified by an undercut with respect to the milling edge which occurs in the ground material. Current attempts to remedy the effects of abrasion include protecting the face sides of the drum from excessive wear and tear by attaching wear plates. This is only satisfactory within limits. Moreover, milled material tends to get stuck in the milling drum case in the machines known from the prior art.

The invention is therefore based on the object of further developing a milling drum in such a way that the wear and tear on the face side of the drum is reduced.

SUMMARY OF THE INVENTION

The milling drum in accordance with one embodiment of the present invention comprises a hollow-cylindrical drum base body (or drum) which axially extends longitudinally and which is defined with respect to its longitudinal axis by an inside radius of the drum and an outside radius of the drum. Several milling tools for grinding and/or removing ground material are arranged on the outside circumferential surface or the jacket surface of the hollow-cylindrical drum. At least one face-side milling tool is further arranged in accordance with the present invention in the region of at least one annular face side of the hollow-cylindrical drum, which milling tool protrudes from the face side or protrudes outwardly from the face side and protects the face side from direct abrasive contact with the ground material to be processed during milling by clearing or cutting free the contact or collision area between this face side of the hollow-cylindrical drum and the ground material by means of this at least one face-side milling tool. Depending on the arrangement and configuration of such a face-side milling tool, the face side of the hollow-cylindrical drum is thus protected at least partly from abrasion, thus preventing or substantially reducing any excessive wear and tear on the face side and on any tool holders and weld seams of the face side.

One relevant aspect of the present invention is the direct protection of the face side of the hollow-cylindrical drum by one or several milling tools, which is why the milling drum in accordance with the present invention is especially also suitable for milling in curves with a relatively small curve radius (e.g. when cutting free manhole covers) despite the given undercut on the milling edge.

It is provided according to a further embodiment that several face-side milling tools are provided on at least one face side of the hollow-cylindrical drum, which milling tools are arranged in a distributed manner in the circumferential direction and especially in an evenly spaced manner.

It is provided according to a further embodiment that at least two face-side milling tools are provided on at least one face side of the hollow-cylindrical drum, which milling tools are arranged at a different radial distance with respect to the longitudinal axis of the hollow-cylindrical drum. The longitudinal axis of the hollow-cylindrical drum corresponds to the rotational axis. The radial distance means the effective distance of a face-side milling tool, i.e. the distance of the tip or the effective point of the milling tool from the longitudinal axis or rotational axis which correlates to a specific cutting circle. As a result of a different radial distance of the face-side milling tool, they move on different circumferential paths during milling operation so that different cutting circles are produced. This may be advantageous especially in the case of thicker hollow-cylindrical drums. The drum thickness is the radial distance between the inside radius of the drum and the outside radius of the drum.

It is provided according to a further embodiment that, of the face-side milling tools, several (i.e. at least two) are provided which are arranged at a different radial distance with respect to the longitudinal axis of the hollow-cylindrical drum. These milling tools, which differ with respect to their radial distance, are distributed in an alternating manner in one circumferential direction and are especially arranged in an equally spaced manner.

It is provided according to a further embodiment that, on at least one face side of the hollow-cylindrical drum, at least one face-side milling tool is arranged in the radial direction (with respect to the longitudinal axis or the rotational axis of the hollow-cylindrical drum) approximately in the middle between the inside radius of the drum and outside radius of the drum, or between the inner circumferential area and the outer circumferential area of the hollow-cylindrical drum. The cutting circle produced by this face-side milling tool lies approximately in the middle of the annular face side of the hollow-cylindrical drum.

It is provided according to a further embodiment that, on at least one face side of the hollow-cylindrical drum, at least one face-side milling tool protrudes in the radial direction (with respect to the longitudinal axis or the rotational axis of the hollow-cylindrical drum) beyond the outside radius of the drum or beyond the outside circumferential area. The face side is protected even better against abrasion as a result of this radial protrusion. The radial protrusion lies in the range of 5 to 15 mm and is especially approximately 10 mm. These numbers refer to an effective distance caused by the milling tip of the face-side milling tool.

It is provided according to a further embodiment that, on at least one face side of the hollow-cylindrical drum, at least one face-side milling tool protrudes radially inward in the radial direction beyond the inside radius of the drum or beyond the inner circumferential area. The face side is protected even better against abrasion as a result of this radial protrusion. The radial protrusion lies in the range of 5 to 15 mm and is especially approximately 10 mm. These numbers refer to an effective distance caused by the milling tip of the face-side milling tool.

It is provided according to a further embodiment that, on at least one face side of the hollow-cylindrical drum, at least one face-side milling tool is arranged with an angle of attack. The angle of attack can be defined, for example, as an inclination angle of the longitudinal axis of the milling tool with respect to a circumferential direction or direction of turning of the hollow-cylindrical drum during milling.

It is provided according to a further embodiment that, on at least one face side of the hollow-cylindrical drum, at least one face-side milling tool is arranged directly in the drum on the face side. The hollow-cylindrical drum is arranged respectively in the region of the face side and comprises e.g. a pocket or the like, as will be explained below in greater detail in connection with the drawings.

It is provided according to a further embodiment that, on at least one face side of the hollow-cylindrical drum, at least one face-side milling tool is arranged as an exchangeable milling tool. A so-called interchangeable tool holder is especially arranged for this purpose on the hollow-cylindrical drum, to which the exchangeable face-side milling tool is fastened.

It is provided according to a further embodiment that the axial longitudinal extension of the milling drum is larger than the (maximum) diameter of this milling drum. The axial longitudinal extension is preferably much larger.

It is provided according to another further embodiment that the axial longitudinal extension of the milling drum is smaller than the (maximum) diameter of this milling drum. Such a milling drum is also known as a milling rotor.

The achievement of the object also extends to a ground milling machine with a control stand (large milling machine), comprising at least one milling drum in accordance with the invention. It especially concerns a road milling machine.

The achievement of the object also extends to a pedestrian-controlled ground milling machine (compact milling machine), comprising at least one milling drum in accordance with the invention. This especially concerns a road milling machine.

BRIEF DESCRIPTION OF THE DRAWINGS

The invention will be explained below by reference to an example shown in the drawings, wherein.

DETAILED DESCRIPTION OF THE INVENTION

Figure 1:
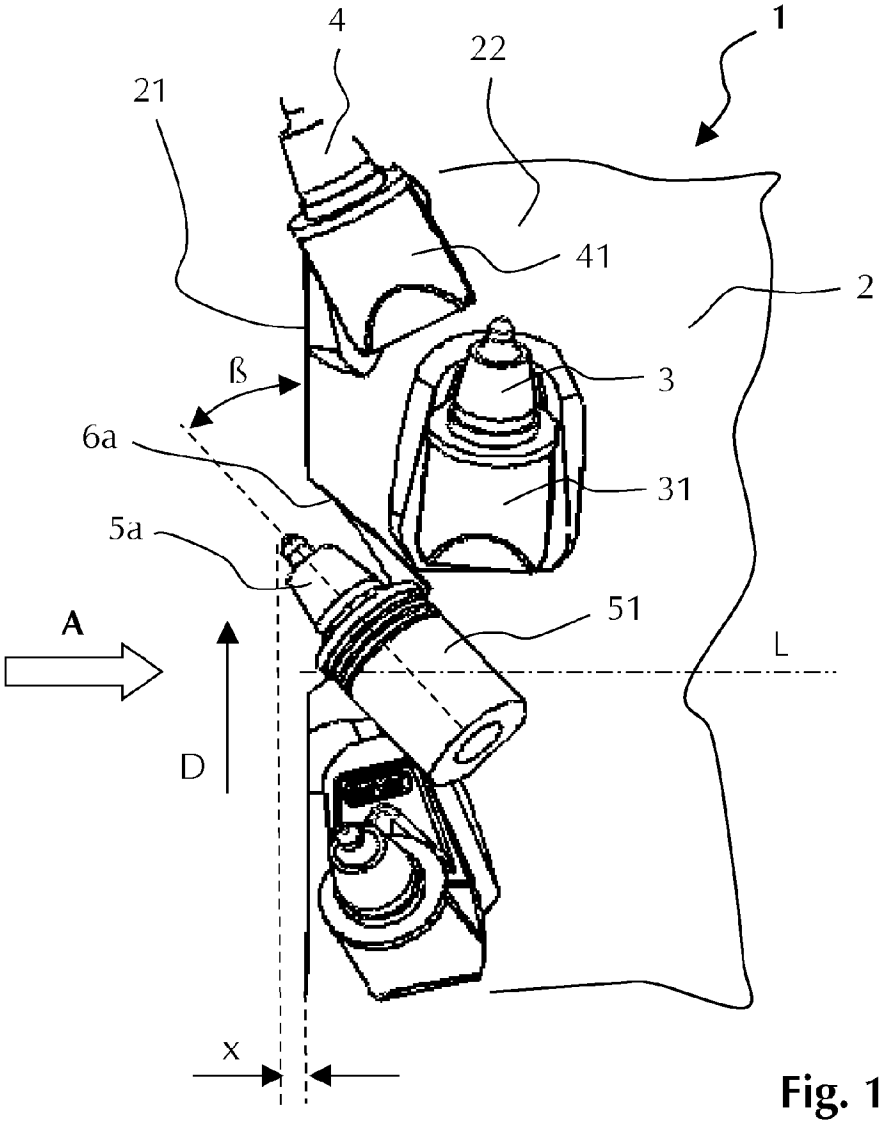
FIG. 1 shows the face region of a milling drum in accordance with one embodiment of the present invention in a side view.

FIG. 1 shows a milling drum in accordance with one embodiment of the present invention which is designated in its entirety with reference numeral 1. The milling drum 1 comprises a drum base body which is arranged as a hollow-cylindrical drum 2. Several milling tools 3 and 4 for grinding and/or removing ground material are arranged on its outside circumferential surface or jacket surface 22. The milling tools 3 and 4 comprise, for example, exchangeable milling tools which are fastened to the drum 2 by means of interchangeable tool holders 31 and 41. The interchangeable tool holders 31 and 41 are in turn tightly welded e.g. on the drum 2. The longitudinal axis of the milling drum 1 and the drum 2 is indicated with L. The longitudinal axis L coincides with the rotational axis. The direction of rotation (or turning direction or milling direction) of the milling drum 1 for milling operation is indicated with D. By way of example, the milling tools 3 with their longitudinal axes are essentially aligned in the turning direction D. Alternatively, the milling tools 3 could also be angled with respect to the turning direction D. Reference numeral 21 indicates the left face side of the drum 2. The angled milling tools 4 which protrude beyond the face side 21 are used for generating a defined milling edge in the ground material to be processed. No protection for the face side 21 can be achieved by means of this milling tool 4, however.

Figure 2:
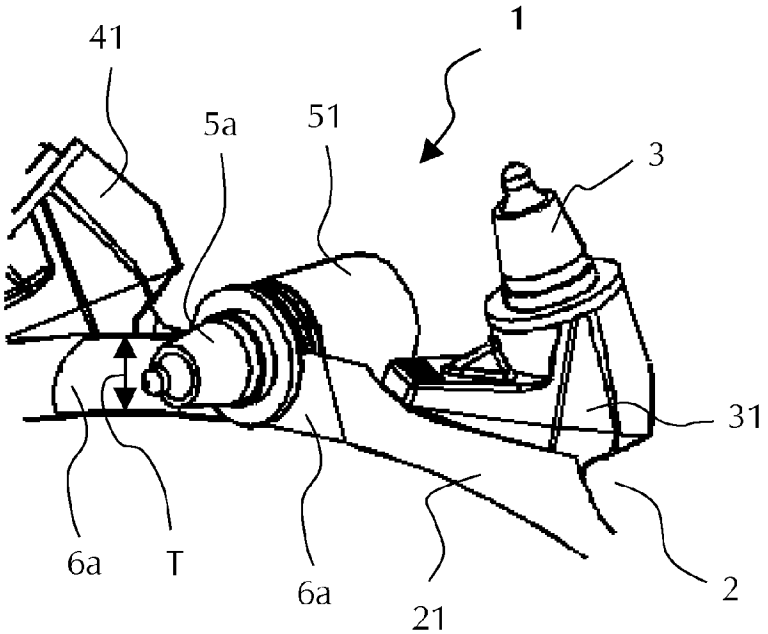
FIG. 2 shows a perspective partial view of the left face side of the milling drum of FIG. 1, according to the direction of view (A) shown in FIG. 1.

Two face-side milling tools 5*a* and 5*b* are arranged in the face-side region for the protection of the face side 21 of drum 2 during milling. Only the face-side milling tool 5*a* is shown in the illustration shown in FIG. 1. The face-side milling tools 5*a* and 5*b* protrude beyond the left face side 21 by a defined amount x (e.g. several millimeters) and are provided to at least partly cut free or clear the collision area between said face side 21 and the ground material to be processed in order to substantially avoid direct contact between the face side 21 and the ground material remaining during processing by milling. FIG. 2 shows the relevant collision area on face side 21 as a radial section T (which substantially corresponds to the thickness of the drum 2). Depending on the arrangement, the face-side milling tools 5*a* and 5*b* can cut free an area which exceeds this radial section T radially to the inside and/or radially to the outside.

The face-side milling tools 5*a* and 5*b* are also arranged as exchangeable milling tools which are fastened to the drum 2 by means of interchangeable tool holders 51. The interchangeable tool holders 51 are arranged in pockets 6*a* and 6*b*, as will be explained below in greater detail in connection with FIG. 4. The face-side milling tools 5*a* and 5*b* are angled at an angle of attack β with respect to the turning direction D or are inclined outwardly in relation to the plane of the left face side 21, as is clearly shown in the illustration of FIG. 1. The angle of attack β can be the same or different for the two face-side milling tools 5*a* and 5*b*. The number of two face-side milling tools 5*a* and 5*b* is merely provided as an example. One face-side milling tool may optionally be sufficient for milling drums with a small diameter. In the case of milling tools with a large diameter or milling tools with thick drums, more than two face-side milling tools can be necessary in order to cut free the collision area.

Figure 3:
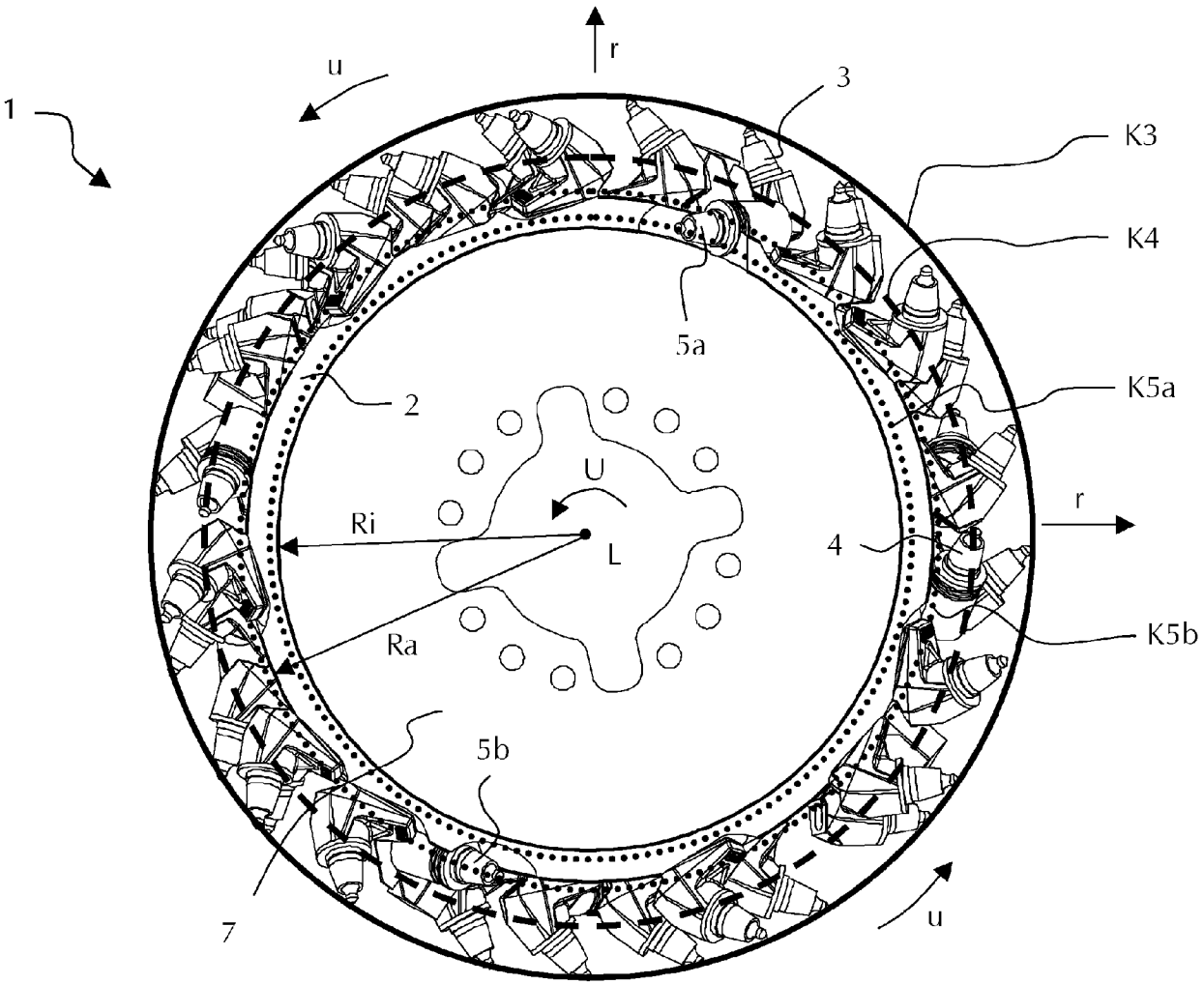
FIG. 3 shows a top view of the left face side of the milling drum of FIG. 1, according to the direction of view (A) shown in FIG. 1.
Figure 6:
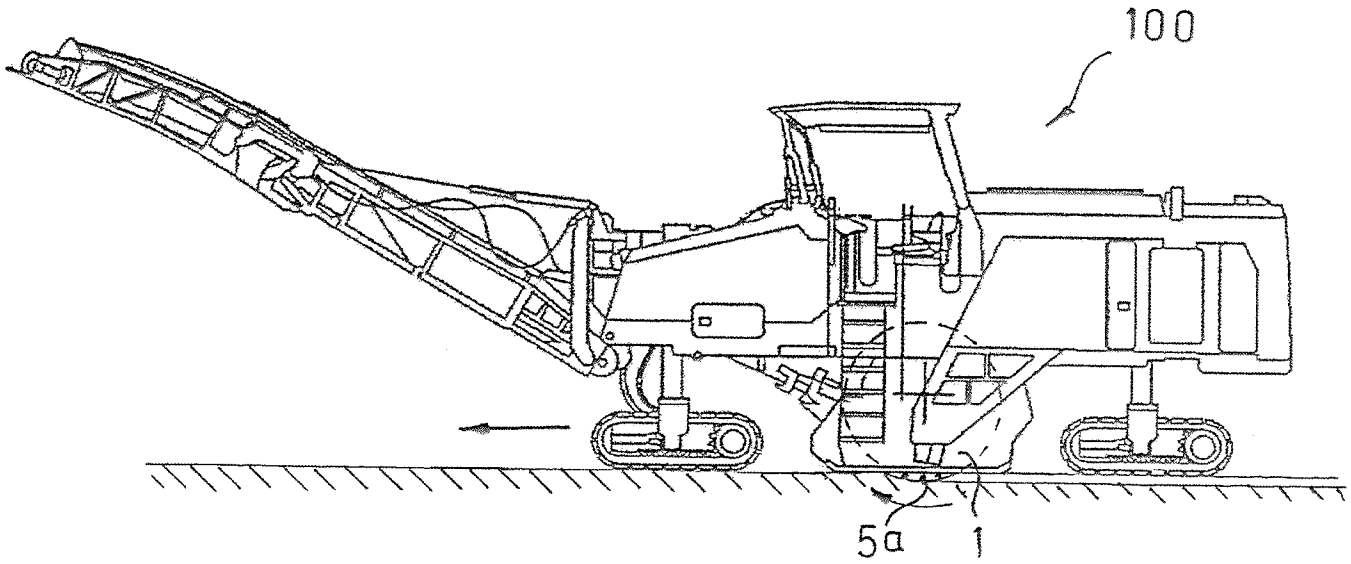
FIG. 6 is a front plan view of an exemplary ground milling machine including the milling drum of FIG. 1 according to one embodiment of the present invention.

FIG. 3 shows a top view of the left face side 21 of milling drum 1, as shown in the direction of view designated with A in FIG. 1. The circular cross section of the drum 2 is shown clearly in this illustration. The drum 2 is defined by an inside circumferential area with an inside radius Ri of the drum and an outside circumferential area 22 with an outside radius Ra of the drum. Furthermore, (at least) one drive plate 7 is present which produces the connection of the drum 2 with a rotary drive and/or a suspension of a ground milling machine, such as the exemplary ground milling machine 100 shown in FIG. 6.

In FIG. 3, K3 indicates an outer milling or cutting circle which is produced during milling by the milling tool 3 which is arranged on the outside circumferential area 22 of drum 2. A lateral milling or cutting circle is designated with K4 which is produced by the milling tool 4 which is slightly inclined outwardly with respect to the left face side 21, which should lead to a clean milling edge in the ground material.

The face side 21 of the drum 2 cannot be protected from abrasion with the milling tools 4. The face-side milling tools 5*a* and 5*b* are provided for this purpose. As is shown in the illustration of FIG. 3, the face-side milling tools 5*a* and 5*b* are arranged offset by approx. 180° in the face-side region of drum 2.

Reference numeral K5*b* designates the milling or cutting circle of the face-side milling tool 5*b* which is arranged a few millimeters radially outside of the outside circumferential surface 22 of drum 2. Reference numeral K5*a* designates the milling or cutting circle of the other face-side milling tool 5*a* which is arranged approximately centrally between the inside circumferential area and the outside circumferential area 22 of drum 2. Similarly, the face-side milling tool 5*a* or a further face-side milling tool could also be arranged in such a way that milling or cutting circle Kx as obtained during milling is arranged radially within the inside circumferential area of the drum 2. The milling tips and thus the effective points of the face-side milling tools 5*a* and 5*b* are thus arranged at different radial distances in relation to the longitudinal axis or rotational axis L. The left face side 21 of the drum 2 is protected from abrasion during milling by the face-side milling tools 5*a* and 5*b* so that excessive wear and tear can be prevented or strongly reduced on this face side and on any tool holders or interchangeable tools holders 31 and 41 and weld seams in the region of this face side 21. Corresponding face-side milling tools are preferably also provided on the other face side of the milling drum 1.

As is further clearly shown in FIG. 3, the milling tools 3 and 4 are inclined with respect to a radial direction r. The milling tools, which are inclined laterally to the outside, have a greater inclination than the milling tools 3 and the milling tips each face in the turning direction U or in the circumferential direction u. The face-side milling tools 5*a* and 5*b* are maximally inclined relative to the radial direction r and have an approximately tangential orientation with respect to the drum 2 in the illustrated drawing, while the milling tips face in the circumferential direction u.

Figure 4:
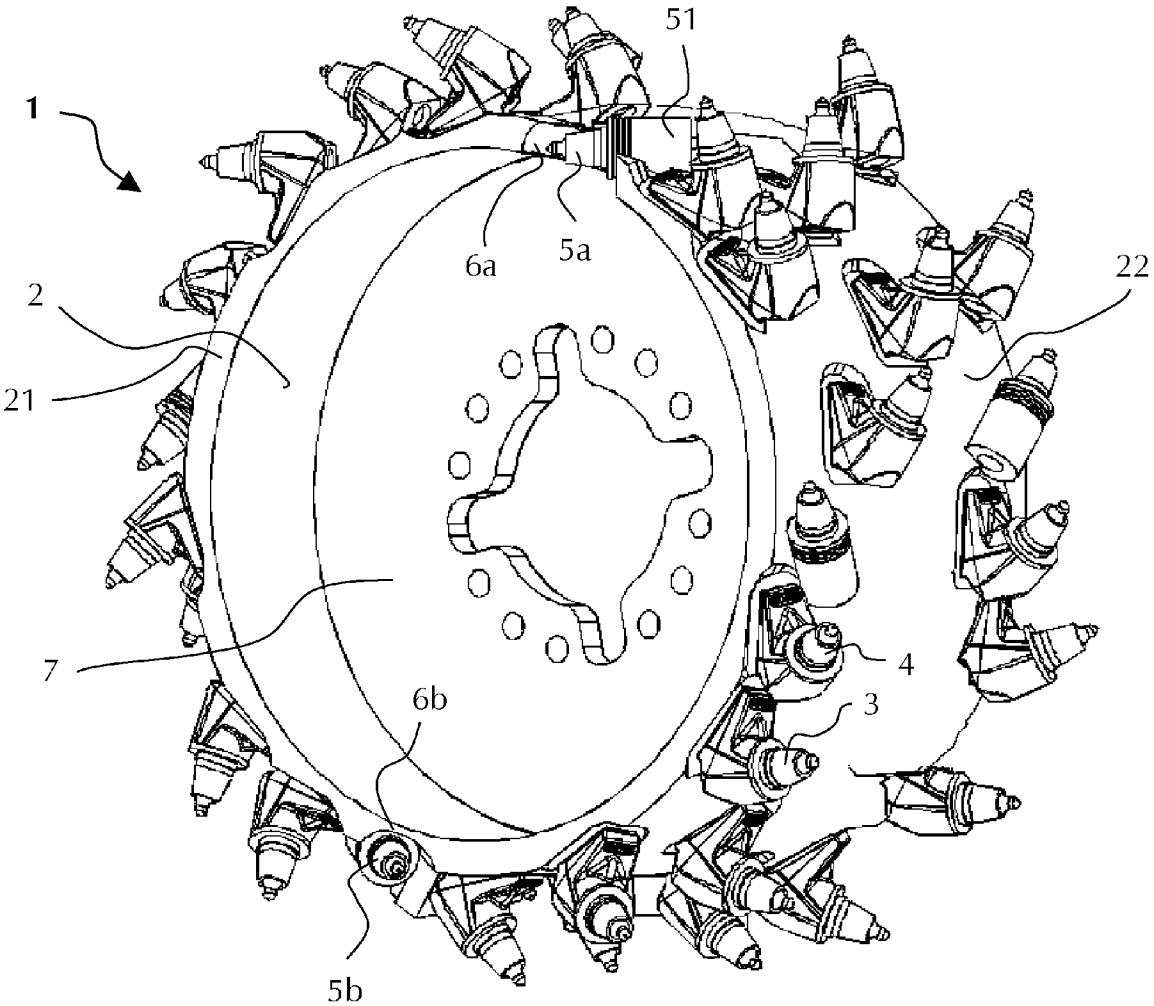
FIG. 4 shows a perspective view of the left face side of the milling drum of FIG. 1.
Figure 5:
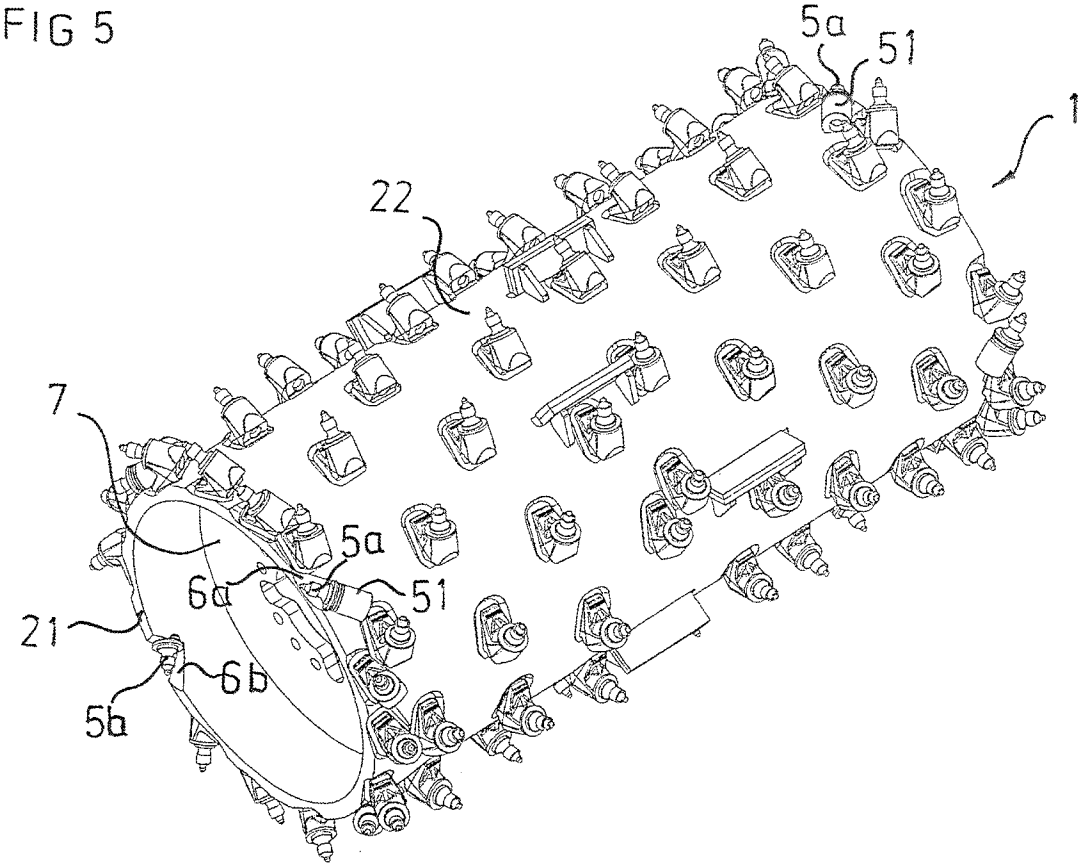
FIG. 5 is a view similar to FIG. 4 showing a milling drum having an axial longitudinal dimension that is greater than a diameter of the drum.

It is clearly shown in the illustration shown in FIG. 4 that the face-side milling tool 5*a* is arranged directly in the drum 2 together with its associated interchangeable tool holder 51. A corresponding pocket or recess 6*a* is incorporated directly in the drum 2 for this purpose, in which the interchangeable tool holder 51 is e.g. welded. The same applies to the second face-side milling tool 5*b*. The pocket 6*b* does not penetrate the entire thickness of the drum 2 in this case.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. A milling drum for a ground milling machine for grinding and/or removing a ground material, comprising:

a hollow-cylindrical drum extending in an axially longitudinal manner between opposite face sides of the drum and being continuous between the opposite face sides, with the hollow-cylindrical drum having a plurality of milling tools arranged on an outside circumferential area of the drum for grinding and/or removing the ground material, wherein at least one face-side milling tool is arranged on the hollow-cylindrical drum in the region of each of the opposite face sides of the drum, with each face-side milling tool being supported by a tool holder located in a pocket formed in respective one of the opposite face sides of the drum and protruding beyond said face side to at least partly cut free a collision region between said face side and the ground material to be processed during milling.

2. The milling drum according to claim 1, wherein at least two face-side milling tools are provided on at least one face side of the hollow-cylindrical drum.

3. The milling drum according to claim 2, wherein the at least two face-side milling tools are distributed in a circumferential direction in an evenly spaced manner on the drum.

4. The milling drum according to claim 1, wherein at least two face-side milling tools are provided on at least one face side of the hollow-cylindrical drum, which at least two face-side milling tools are arranged at a different radial distance with respect to the longitudinal axis of the hollow-cylindrical drum.

5. The milling drum according to claim 4, wherein the at least two milling tools are distributed in an alternating manner in one circumferential direction.

6. The milling drum according to claim 5, wherein the at least two face-side milling tools are arranged in an evenly spaced manner on the drum.

7. The milling drum according to claim 1, wherein at least one face-side milling tool is arranged on at least one face side of the hollow-cylindrical drum in the radial direction approximately in the middle between an inside circumferential area and the outside circumferential area of the hollow-cylindrical drum.

8. The milling drum according to claim 1, wherein at least one face-side milling tool protrudes radially to the outside on at least one face side of the hollow-cylindrical drum in a radial direction beyond the outside circumferential area of the hollow-cylindrical drum.

9. The milling drum according to claim 1, wherein at least one face-side milling tool protrudes radially to the inside on at least one face side of the hollow-cylindrical drum in the radial direction beyond an inside circumferential area of the hollow-cylindrical drum.

10. The milling drum according to claim 1, wherein at least one face-side milling tool is arranged with an angle of attack on at least one face side of the hollow-cylindrical drum.

11. The milling drum according to claim 1, wherein, on at least one face side of the hollow-cylindrical drum, at least one face-side milling tool is arranged directly in the drum on the face side.

12. The milling drum according to claim 1, wherein at least one face-side milling tool is arranged as an exchangeable milling tool on at least one face side of the hollow-cylindrical drum.

13. The milling drum according to claim 1, wherein an axial longitudinal dimension of the drum is greater than a diameter of the drum.

14. The milling drum according to claim 1, wherein an axial longitudinal dimension of the drum is less than a diameter of the drum.

15. A milling drum for a ground milling machine for grinding and/or removing a ground material, comprising:

a hollow-cylindrical drum extending in an axially longitudinal manner and having an inside circumferential area and an outside circumferential area that define a thickness of the drum, with the hollow-cylindrical drum having a plurality of milling tools arranged on the outside circumferential area of the drum for grinding and/or removing the ground material, wherein at least one face-side milling tool is arranged on the hollow-cylindrical drum in the region of at least one face side, which at least one face-side milling tool is supported by a tool holder located in a pocket formed in the at least one face side, with the pocket not penetrating the entire thickness of the drum, and which at least one face-side milling tool protrudes beyond said face side and is provided during milling to at least partly cut free a collision region between said face side and the ground material to be processed.

* * * * *